US007891792B2

(12) United States Patent
Gold et al.

(10) Patent No.: US 7,891,792 B2
(45) Date of Patent: Feb. 22, 2011

(54) SOLID INK STICK WITH TRANSITION INDICATING REGION

(75) Inventors: Christopher Ryan Gold, Tigard, OR (US); Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 656 days.

(21) Appl. No.: 11/982,914

(22) Filed: Nov. 6, 2007

(65) Prior Publication Data

US 2009/0115824 A1 May 7, 2009

(51) Int. Cl.
*B41J 2/175* (2006.01)

(52) U.S. Cl. ..... 347/88; 347/99

(58) Field of Classification Search ..... 347/88, 347/99

See application file for complete search history.

(56) References Cited

U.S. PATENT DOCUMENTS

| | | | |
|---|---|---|---|
| 5,223,860 | A | 6/1993 | Loofbourow et al. |
| 5,442,387 | A | 8/1995 | Loofbourow et al. |
| 5,734,402 | A | 3/1998 | Rousseau et al. |
| 5,861,903 | A | 1/1999 | Crawford et al. |
| 5,975,688 | A | 11/1999 | Kanaya et al. |
| 6,056,394 | A | 5/2000 | Rousseau et al. |
| 6,213,600 | B1 | 4/2001 | Kobayashi et al. |
| 6,247,805 | B1 | 6/2001 | Iwaya |
| 6,317,149 | B1 | 11/2001 | Mochida et al. |
| 6,565,200 | B1 | 5/2003 | Jones |
| 6,648,435 | B1 | 11/2003 | Jones |
| 6,672,716 | B2 | 1/2004 | Jones |
| 6,761,443 | B2 | 7/2004 | Jones |
| 6,820,815 | B2 | 11/2004 | Meunier et al. |

(Continued)

FOREIGN PATENT DOCUMENTS

EP 1359014 A1 11/2003

(Continued)

OTHER PUBLICATIONS

Non-Final Office Action for U.S. Appl. No. 11/473,610, mailed Mar. 24, 2009, United States Patent and Trademark Office (6 pages).

(Continued)

*Primary Examiner*—Matthew Luu
*Assistant Examiner*—Rut Patel
(74) *Attorney, Agent, or Firm*—Maginot, Moore & Beck LLP

(57) ABSTRACT

An ink stick comprises an ink stick body having a plurality of tracks formed in one or more side surfaces extending from a leading surface to a trailing surface substantially parallel to a feed direction of the ink loader. Each track forms a path corresponding to a track sensor in the ink loader and includes a leading sensor actuator and a trailing sensor actuator for actuating the respective track sensor. The leading sensor actuators and the trailing sensor actuators are configured to actuate the respective track sensors in an actuation sequence indicative of variable control/attribute information pertaining to the ink stick. A transition indicating region is formed between the leading sensor actuators and the trailing sensor actuators in the plurality of tracks. The transition indicating region is configured to interact with the track sensors to generate a signal indicative of a transition between the leading sensor actuators and the trailing sensor actuators.

12 Claims, 9 Drawing Sheets

U.S. PATENT DOCUMENTS

| | | | | |
|---|---|---|---|---|
| 6,840,613 | B2 | 1/2005 | Jones | |
| 6,924,835 | B1 | 8/2005 | Silverbrook et al. | |
| 2003/0038851 | A1 | 2/2003 | Oriol | |
| 2006/0279617 | A1* | 12/2006 | Korn et al. | 347/88 |
| 2007/0296783 | A1* | 12/2007 | Jones | 347/88 |
| 2008/0117265 | A1* | 5/2008 | Esplin et al. | 347/85 |

FOREIGN PATENT DOCUMENTS

| | | | |
|---|---|---|---|
| EP | 1359015 | A1 | 11/2003 |
| EP | 1359024 | A1 | 11/2003 |
| EP | 1731315 | A1 | 12/2006 |

OTHER PUBLICATIONS

Amendment in Response to Non-Final Office Action for U.S. Appl. No. 11/473,610, Submitted Apr. 17, 2009 (11 pages).
Non-Final Office Action for U.S. Appl. No. 11/473,611, Mailed Oct. 16, 2008, United States Patent and Trademark Office (18 pages).
Amendment in Response to Non-Final Office Action for U.S. Appl. No. 11/473,611, Submitted Jan. 15, 2009 (18 pages).
Non-Final Action for U.S. Appl. No. 11/473,632, Mailed Jun. 4, 2009, United States Patent and Trademark Office (10 pages).
Amendment in Response to Non-Final Office Action for U.S. Appl. No. 11/473,632, Submitted Aug. 17, 2009 (13 pages).
Final Office Action for U.S. Appl. No. 11/473,632, Mailed Nov. 13, 2009, United States Patent and Trademark Office (9 pages).
Amendment Accompanying a Request for Continued Examination for U.S. Appl. No. 11/473,632, Submitted Feb. 16, 2010 (12 pages).
Second Non-Final Office Action for U.S. Appl. No. 11/473,632, Mailed Mar. 30, 2010, United States Patent and Trademark Office (10 pages).
Amendment in Response to Second Non-Final Office Action for U.S. Appl. No. 11/473,632, Submitted May 3, 2010 (12 pages).
Second Final Office Action for U.S. Appl. No. 11/473,632, Mailed Jun. 24, 2010, United States Patent and Trademark Office (12 pages).
Amendment in Response to Second Final Office action for U.S. Appl. No. 11/473,632, Submitted Aug. 24, 2010 (9 pages).

* cited by examiner

SOLID INK STICK WITH TRANSITION INDICATING REGION

CROSS-REFERENCE TO RELATED APPLICATIONS

Reference is made to commonly-assigned copending U.S. patent applications Ser. No. 11/473,610 entitled "Ink Loader for Interfacing with Solid Ink Sticks", Ser. No. 11/473,632, entitled "Solid Ink Stick with Interface Element", and Ser. No. 11/473,656, entitled "Solid Ink Stick with Coded Sensor Feature", Ser. No. 11/473,611, entitled "Solid Ink Stick with Enhanced Differentiation", the entire disclosures of which are expressly incorporated by reference herein.

TECHNICAL FIELD

This disclosure relates generally to phase change ink jet printers, the solid ink sticks used in such ink jet printers, and the load and feed apparatus for feeding the solid ink sticks within such ink jet printers.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a heater plate in the heater assembly. The heater plate melts the solid ink impinging on the plate into a liquid that is delivered to a print head for jetting onto a recording medium.

One difficulty faced in solid ink technology is differentiation and identification of ink sticks to ensure the correct loading and compatibility of an ink stick with the imaging device in which it is used. Provisions have been made to ensure that an ink stick is correctly loaded into the intended feed channel and to ensure that the ink stick is compatible with that printer. One such provision is directed toward physically excluding wrong colored or incompatible ink sticks from being inserted into the feed channels of the printer. For example, the correct loading of ink sticks has been accomplished by incorporating keying, alignment and orientation features into the exterior surface of an ink stick. These features are protuberances or indentations that are located in different positions on an ink stick. Corresponding keys or guide elements in the ink loader of the phase change ink printer exclude ink sticks which do not have the appropriate perimeter key elements while ensuring that the ink stick is properly aligned and oriented in the feed channel.

World markets with various pricing and color table preferences, however, have created a situation where multiple ink types may exist in the market simultaneously with nearly identical size/shape ink and/or ink packaging. Thus, ink sticks may appear to be substantially the same but, in fact, may be intended for different phase change printing systems due to factors such as, for example, market pricing or color table. Due to the broad range of possible ink stick configurations, marketing strategies, pricing, etc., differentiating the inks sticks so only appropriate ink is accepted by a printer requires methods of identification that go beyond physical keying.

In response to the identification requirements posed by the broad range of ink stick configurations, ink sticks have been developed that include sensor features. Sensor features comprise one or more features formed into the exterior surface of ink sticks that are configured to interact with sensors in the ink delivery system. Ink stick data may be encoded into these features by configuring the features to actuate one or more sensors in an ink loader to generate a signal or coded pattern of signals that corresponds to information specific to the ink stick. The ink stick data encoded onto the ink stick may be read by the print controller in a suitably equipped phase change ink jet printing device to control imaging operations. For example, the controller may enable or disable operations, optimize operations or influence or set operation parameters based on the ink stick data encoded onto the ink stick.

Reading an encoded sensor feature incorporated into an ink stick typically requires moving or transporting an ink stick past the appropriate sensor in the feed channel. Ink stick movement in the feed channel generally corresponds to the melt rate of ink sticks at the heater plate. Melt cycles are only performed as needed by the printer. Therefore, when a melt cycle is not being performed, ink sticks may remain stationary in the feed channel. Ink stick movement may also be in response to a loading motion in which a loaded ink stick is "pushed" into contact with ink sticks already loaded into the feed channel at which point it is moved at the melt rate along with the other ink sticks. These variations in movement rate of ink sticks and the timing in which ink sticks interact with the sensors in the feed channel increases the likelihood of incorrect sensing or reading of the encoding feature.

SUMMARY

An ink stick for use in an ink loader of an imaging device includes an transition indicating region configured to provide an indication of the position of the ink stick with respect to sensors in the ink loader so variations in the rate and timing that ink sticks may traverse the sensor region in a feed channel does not adversely affect the reading of a coded sensor feature on the ink stick. The ink stick comprises an ink stick body configured to be received in a feed channel of an ink loader of a phase change ink imaging device and to be moved in the feed channel in a feed direction from an insertion end to a melt end of the feed channel. The ink stick body includes a leading end and a trailing end. The ink stick body is configured for insertion into the ink loader with the leading end oriented in the feed direction and the trailing end oriented opposite the feed direction. A plurality of first sensor actuators is located proximate the leading end of the ink stick body and is positioned on the ink stick body to interact with at least one sensor in the feed channel as the ink stick body is moved toward the melt end in order to generate a first signal corresponding to a first portion of a code word. A plurality of second sensor actuators is located proximate the trailing end of the ink stick body. The plurality of second sensor actuators is positioned on the ink stick body to interact with the at least one sensor in the feed channel as the ink stick body is moved toward the melt end in order to generate a second signal corresponding to a second portion of the code word. A transition indicator is positioned on the ink stick body between the plurality of first sensor actuators and the plurality of second sensor actuators. The transition indicator is configured to interact with the at least one sensor in the feed channel to generate a transition signal indicative of a transition from the generation of the first signal to the generation of the second signal.

In another embodiment, a system for a phase change imaging device is provided. The system comprises a coded sensor feature formed on an exterior surface of an ink stick. The coded sensor feature includes a plurality of first sensor actuators and a plurality of second sensor actuators. The plurality of first sensor actuators is arranged proximate a leading end of the ink stick in a first sequence. The plurality of second sensor actuators is arranged proximate a trailing end of the ink stick in a second sequence. A transition indicating region is formed on the exterior surface of the ink stick between the plurality of first sensor actuators and the plurality of second sensor actuators. The system includes a sensor system in an ink loader of the phase change imaging device for detecting the plurality of first sensor actuators and the plurality of second sensor actuators and to generate a first signal corresponding to the first sequence and a second signal corresponding to the second sequence. The sensor system is configured to detect the transition indicating region to differentiate between the detection of the plurality of first sensor actuators and the detection of the plurality of second sensor actuators.

In yet another embodiment, a method of feeding ink sticks in an ink loader of a phase change imaging device is provided. The method comprises inserting an ink stick into an ink loader of a phase change imaging device. The ink stick includes a coded sensor feature formed on an exterior surface of the ink stick. The coded sensor feature includes a plurality of tracks forming paths substantially parallel to a feed direction of the ink loader on the exterior surface of the ink stick. Each track in the plurality includes a leading sensor actuator and a trailing sensor actuator. The leading sensor actuators and the trailing sensor actuators are arranged in an actuation sequence. The ink stick also includes an transition indicating region formed on the exterior surface in each track in the plurality of tracks between the leading sensor actuators of the plurality of tracks and the trailing sensor actuators of the plurality of tracks. The leading sensor actuators of the plurality of tracks are detected with a plurality of track sensors. The transition indicating region is also detected. The plurality of track sensors. is set to detect the trailing sensor actuators in response to the detection of the transition indicating region. The trailing sensor actuators of the plurality of tracks are then detected with the plurality of track sensors. A signal indicative of the actuation. sequence is generated based on the detection of the leading sensor actuators and the trailing sensor actuators by the plurality of track sensors.

DETAILED DESCRIPTION OF THE PREFERRED EMBODIMENT

Figure 1:
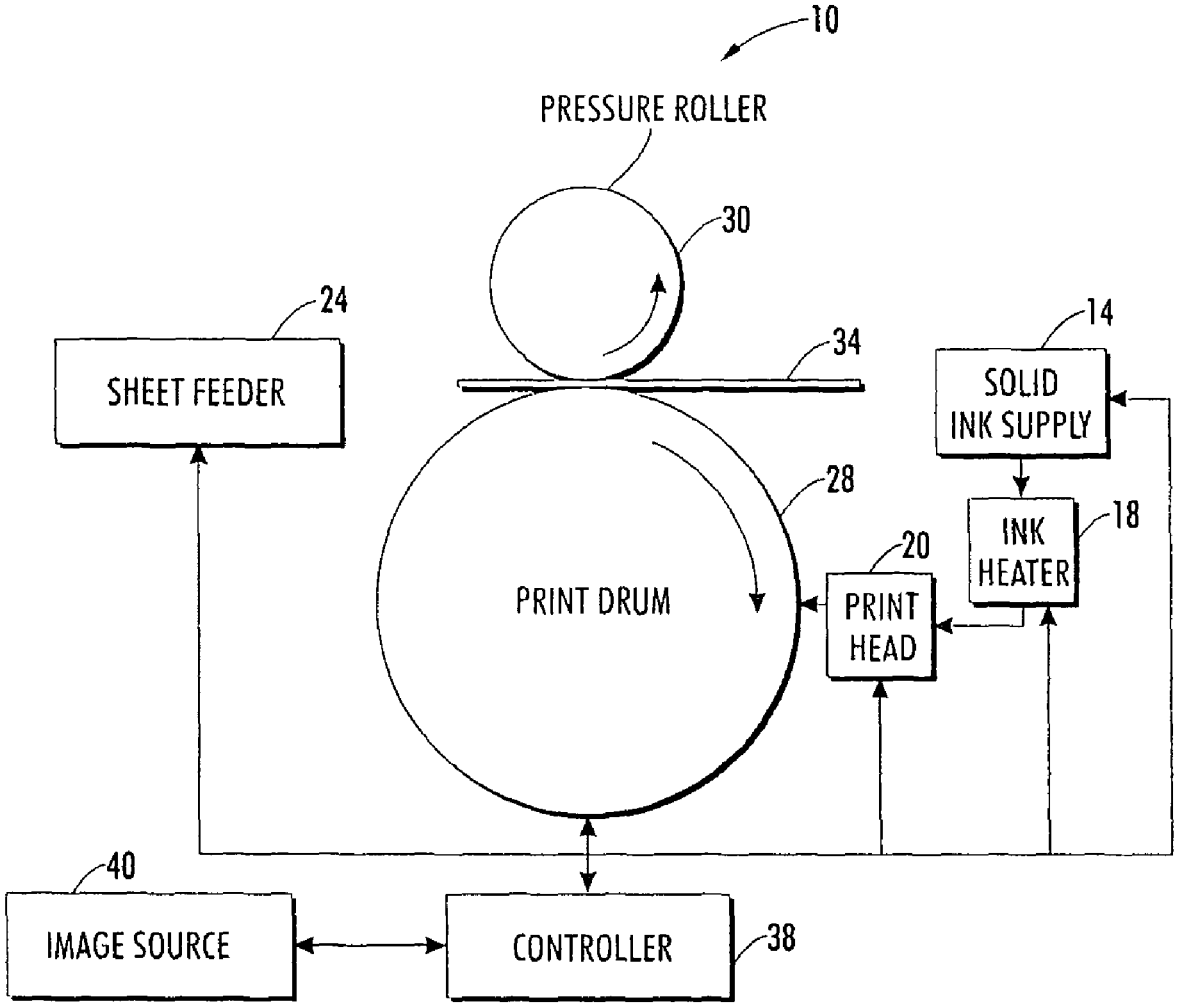
FIG. 1 PRIOR ART
FIG. 1 is a block diagram of a phase change ink imaging device.

For a general understanding of the present embodiments, reference is made to the drawings. In the drawings, like reference numerals have been used throughout to designate like elements. As used herein, the term "printer" refers, for example, to reproduction devices in general, such as printers, facsimile machines, copiers, and related multi-function products, and the term "print job" refers, for example, to information including the electronic item or items to be reproduced. References to ink delivery or transfer from an ink cartridge or housing to a printhead are intended to encompass the range of melters, intermediate connections, tubes, manifolds and/or other components and/or functions that may be involved in a printing system but are not immediately significant to the present invention.

Referring now to FIG. 1, there is illustrated a block diagram of an embodiment of a phase change ink imaging device 10. The imaging device 10 has an ink supply 14 which receives and stages solid ink sticks. An ink melt unit 18 heats the ink stick above its melting point to produce liquefied ink. The melted ink is supplied to a printhead assembly 20 by gravity, pump action, or both. The imaging device 10 may be a direct printing device or an offset printing device. In a direct printing device, the ink may be emitted by the print head 20 directly onto the surface of a recording medium.

The embodiment of FIG. 1 shows an indirect, or offset, printing device. In offset printers, the ink is emitted onto a transfer surface 28 that is shown in the form of a drum, but could be in the form of a supported endless belt. To facilitate the image transfer process, a pressure roller 30 presses the media 34 against the ink on the drum 28 to transfer the ink from the drum 28 to the media 34.

Operation and control of the various subsystems, components and functions of the machine or printer 10 are performed with the aid of a controller 38. The controller 38, for example, may be a micro-controller having a central processor unit (CPU), electronic storage, and a display or user interface (UI). The controller reads, captures, prepares and manages the image data flow between image sources 40, such as a scanner or computer, and imaging systems, such as the printhead assembly 20. The controller 38 is the main multitasking processor for operating and controlling all of the other machine subsystems and functions, including the machine's printing operations, and, thus, includes the necessary hardware, software, etc. for controlling these various systems.

Figure 2:
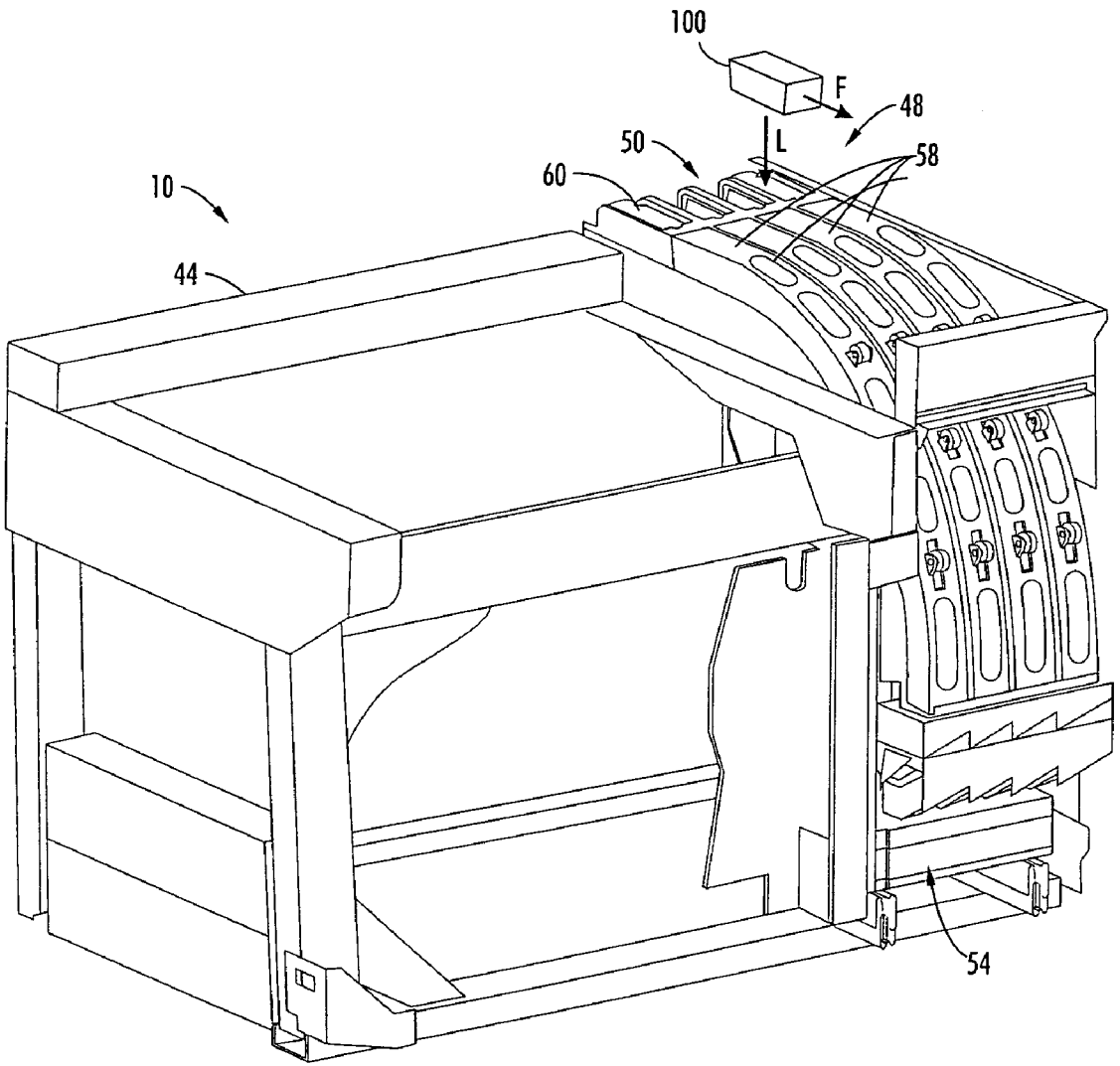
FIG. 2 is an enlarged partial top perspective view of an embodiment of an incomplete phase change ink imaging device with an ink loader.

Referring now to FIG. 2, the device 10 includes a frame 44 to which the operating systems and components are directly or indirectly mounted. A solid ink delivery system 48 advances ink sticks from loading station 50 to a melting station 54. The loading station includes keyed openings 60. Each keyed opening 60 limits access to one of the individual feed channels 58 of the ink delivery system. The keyed openings 60 are configured to accept only those ink sticks having key elements that comport with the key structures of the openings 60. Thus, the keyed openings 60 help limit the ink sticks inserted into a channel to a particular configuration such as color, ink formulation, etc. The ink delivery system 48 includes a plurality of channels, or chutes, 58 for transporting ink sticks from the loading station 60 to the melting station 54. A separate channel 58 is utilized for each of the four colors: namely cyan, magenta, black and yellow. The melting station 54 is configured to melt the solid ink sticks and supply the liquid ink to a printhead system (not shown).

In the embodiment of FIG. 2, the loading station receives ink sticks inserted through the keyed openings 60 in an insertion direction L. The feed channels are configured to transport ink sticks in a feed direction F from the loading station to the melting station. In the embodiment of FIG. 2, the insertion and feed directions L and F are different. For example, ink sticks may be inserted in the insertion direction L and then moved along the feed channel in the feed direction F. In an alternative embodiment, the feed channels and keyed openings may be oriented such that the insertion and feed directions L and F are substantially parallel.

Figure 3:
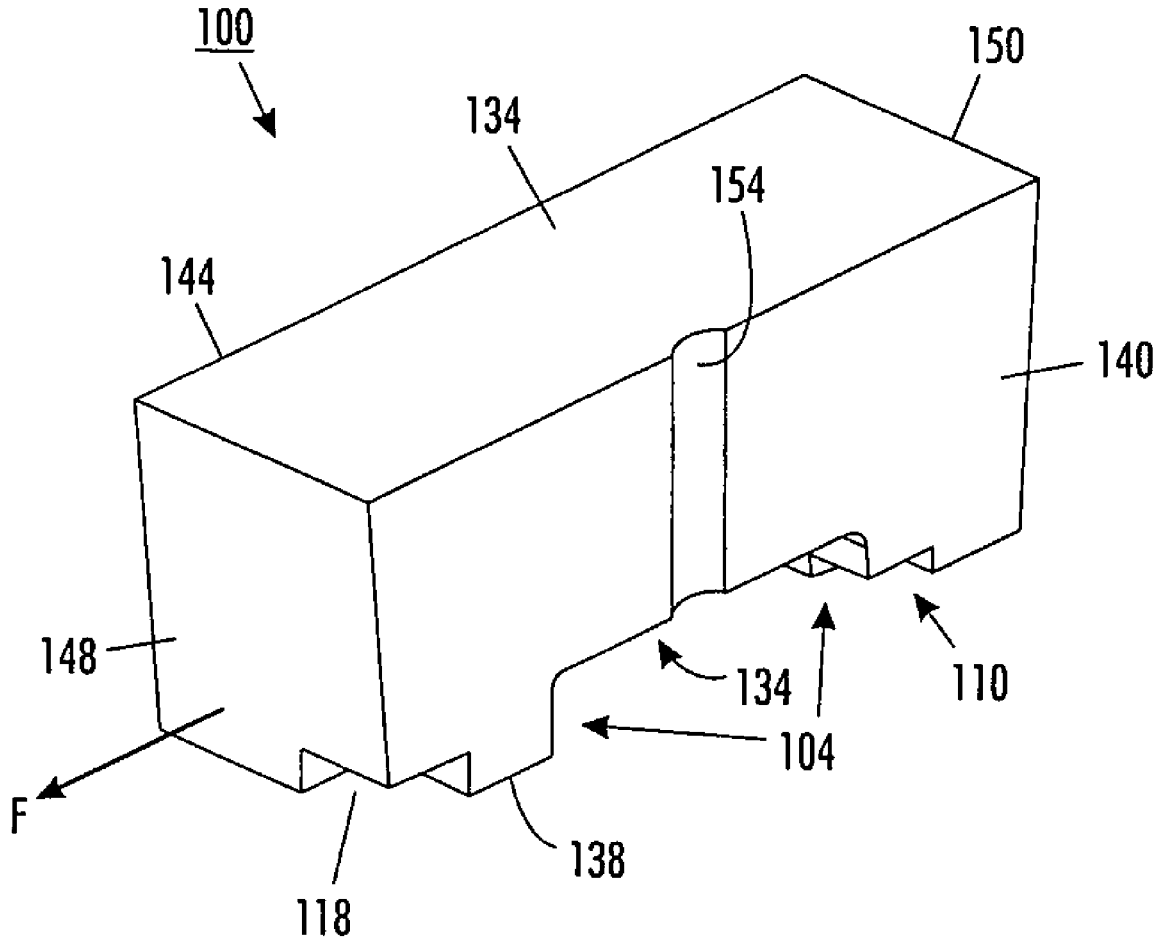
FIG. 3 is a perspective view of one embodiment of a solid ink stick with an embossed visual orientation indicator.

An ink stick may take many forms. One exemplary embodiment of a solid ink stick 100 for use in the ink delivery system is illustrated in FIG. 3. The ink stick has a bottom surface 138 and a top surface 134. The particular bottom surface 138 and top surface 134 illustrated are substantially parallel one another, although they can take on other contours and relative relationships. Moreover, the surfaces of the ink stick body need not be flat, nor need they be parallel or perpendicular one another. The ink stick body also has a plurality of side extremities, such as lateral side surfaces 140, 144 and end surfaces 148, 150. The side surfaces 140 and 144 are substantially parallel one another, and are substantially perpendicular to the top and bottom surfaces 134, 138. The end surfaces 148, 150 are also basically substantially parallel one another, and substantially perpendicular to the top and bottom surfaces, and to the lateral side surfaces. One of the end surfaces 148 is a leading end surface, and the other end surface 150 is a trailing end surface. The ink stick body may be formed by pour molding, injection molding, compression molding, or other known techniques.

Ink sticks may include a number of features that aid in correct loading, guidance and support of the ink stick when used. These loading features may comprise protrusions and/or indentations that are located in different positions on an ink stick for interacting with key elements, guides, supports, sensors, etc. located in complementary positions in the ink loader. For example, as shown in FIG. 3, the ink stick may include one or more insertion keying features 154. The stick keying features interact with the keyed openings 60 of the loading station 50 to admit or block insertion of the ink sticks through the insertion opening 60 of the solid ink delivery system. In the ink stick embodiment of FIG. 3, the key element 154 is a vertical recess or notch formed in side surface 140 of the ink stick body. The corresponding complementary key (not shown) on the perimeter of the keyed opening 60 is a complementary protrusion into the opening 60. Any number or shape of key features may be employed in any suitable position on the ink stick.

As an alternative to or in addition to the use of keying, alignment and orientation features, the ink stick may include a coded sensor feature 104 for encoding variable control information or attribute information into the ink stick 100. As explained in more detail below, the coded sensor feature 104 is configured to interact with a sensor system in a feed channel of the ink delivery system in order to generate one or more coded signals configured to convey the variable control information to the controller. The coded signals may take any form that is suitable to convey information to an imaging device control system. A coded sensor feature may be located in a predetermined position on the ink stick corresponding to sensor locations in a feed channel.

Figure 4:
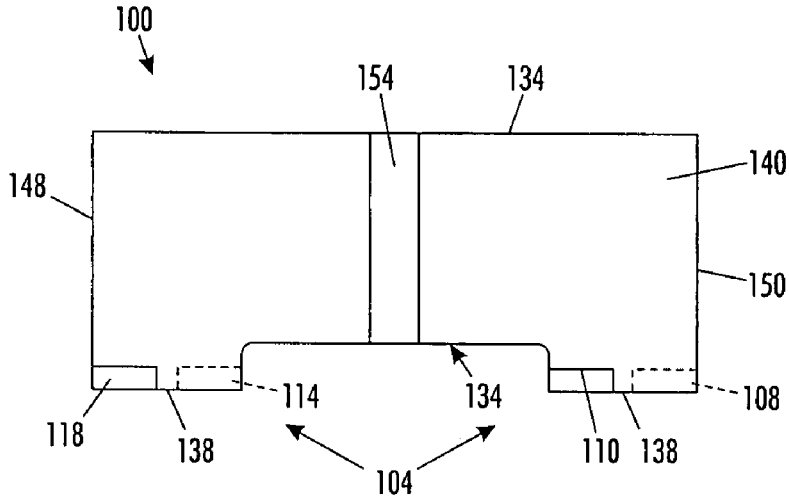
FIG. 4 is a side view of the ink stick of FIG. 3.
Figure 5:
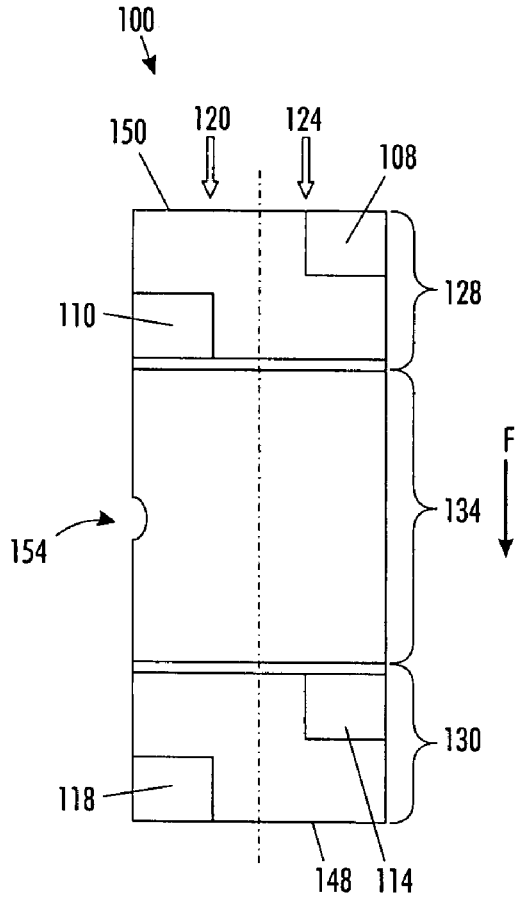
FIG. 5 is a bottom view of the ink stick of FIG. 3.

Referring now to FIGS. 4 and 5, the sensor feature 104 is shown on the bottom surface 138 of the ink stick although the sensor feature may be formed on any surface or more than one surface of the ink stick depending on sensor placement in the feed channel. The coded sensor feature may be used to embed information onto the ink stick that identifies the ink stick, such as a serial number, an identification code, or other index mechanism, an origin of the ink stick, ink stick formulation, date of manufacturing, stock keeping unit (SKU) number, etc.

As best seen in FIG. 5, the coded sensor feature includes a plurality of sensor actuators 108, 110, 114, 118 arranged in generally linear arrays or tracks 120, 124. As explained below, the sensor actuators 108, 110, 114, 118 of the tracks 120, 124 are configured to interact with track sensors (not shown) positioned in a feed channel to generate the coded signals. The ink stick of FIG. 5 includes two tracks 120, 124 although the ink stick may have more than two tracks. Each track forms a path substantially parallel to the feed direction F and is formed on a portion of the exterior surface of the ink stick that corresponds to sensor positions in the ink delivery system. By arranging the sensor actuators in tracks parallel to the feed direction, the sensor actuators of a track may be "read" by a single sensor as the ink stick is urged along the feed channel.

The tracks of coded sensor feature of FIG. 5 are divided into a leading segment 130 and a trailing segment 128 by a transition indicating region 134 (explained in more detail below). The leading 130 and trailing segments 128 of the tracks comprise potential locations along the track for the placement of one or more sensor actuators. One or more sensor actuators may be positioned at one or more of the leading and trailing segments of the tracks. Sensor actuators, however, need not be positioned in both the leading and trailing segments. Some tracks may have sensor actuators at only one of the leading and trailing segments, and some tracks may not have sensor actuators at either of the leading and trailing segments. Sensor actuators may be positioned at any point along the track in the leading and/or trailing segments. For example, a sensor actuator may be positioned at any point along the leading segment of a track between the leading end of the ink stick and the transition indicating region.

Sensor actuators may have any suitable configuration that permits reliable sensor actuation, directly or indirectly, such as by moving a flag or using an optical sensing system. For example, sensor actuators may comprise protrusions or indentations on the exterior surface of an ink stick. Some sensor actuators may have surfaces configured to reflect light from an optical source onto an optical detector. Alternatively, sensor actuators may be configured to actuate one or more sensors based on a physical dimension of the sensor actuator, such as, for example, depth, length, width or spacing between elements or any combination of dimensional features. In one embodiment, sensor actuators may be configured to actuate a sensor to produce "high" and/or "low" sensor output signals. For example, the sensor actuators 108, 110, 114, 118 of FIGS. 3-5 comprise insets that are configured to produce a "high" signal output while the non-inset areas of the tracks are configured to produce a "low" signal output. Sensor states of high and low may be inverted in a particular implementation without affecting the functionality of the coded sensor feature. Binary representations of data may be less complex to implement than other data representation schemes and may have a high signal-to-noise ratio because there are only two possible signal values to be detected. Any suitable data representation scheme, however, may be utilized.

Figure 5A:
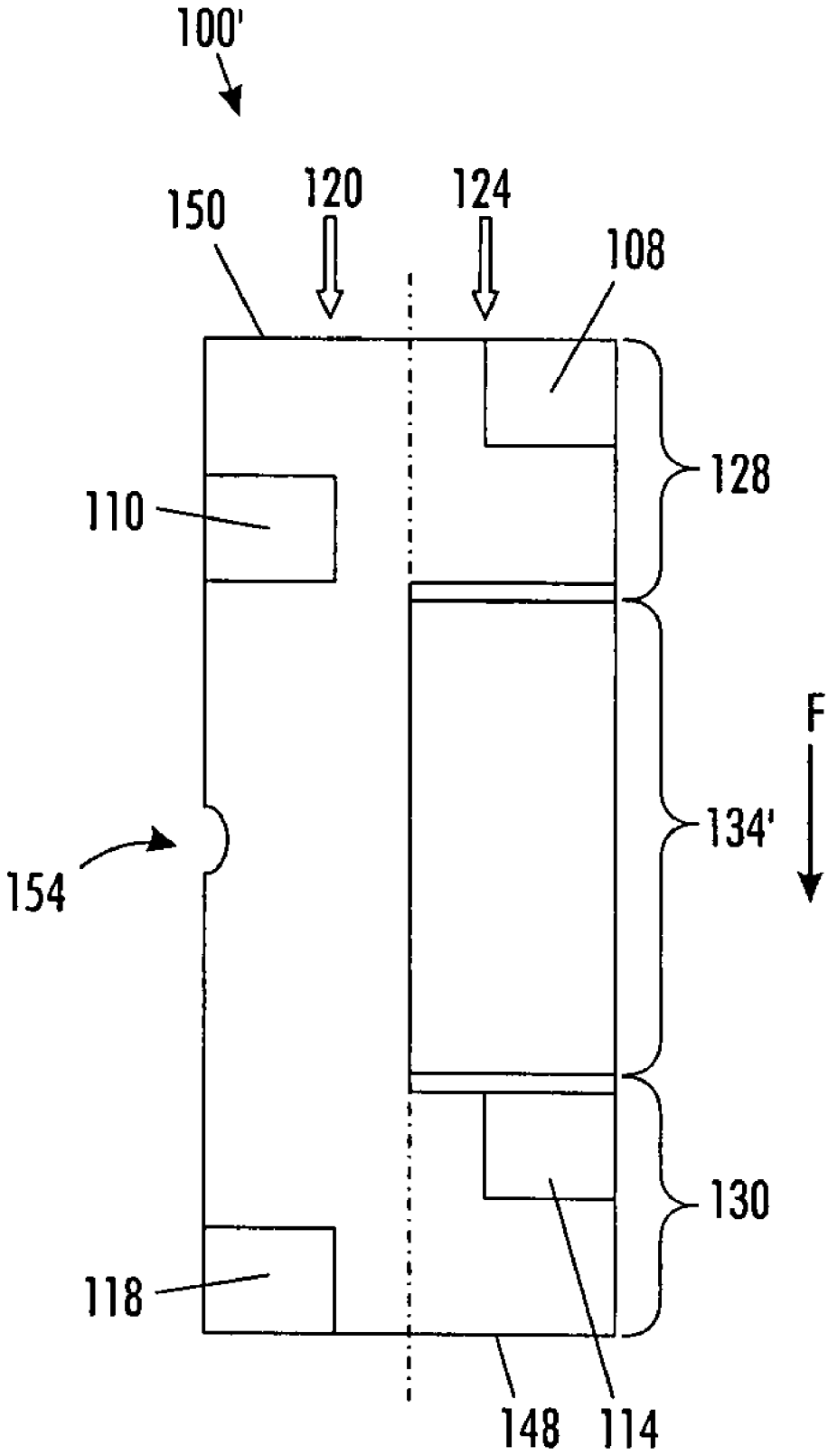
FIG. 5A is a bottom view of an alternative embodiment of an ink stick.

To differentiate between the sensor actuations caused by the leading end sensor actuators 114, 118 and the actuations caused by the trailing end sensor actuators 108, 110 of a track, the coded sensor feature includes one or more transition indicating regions 134. A transition indicating region 134 is configured to provide an indication to the control system that the leading segments 130 of the tracks have passed the sensor region and that the next actuations that may occur are due to sensor actuators positioned in the trailing segments 128 of the tracks. The use of a transition indicating region 134 between the leading segment 130 and the trailing segment 128 of the tracks enables a distinction to be made between the actuations of a track sensor by sensor actuators in the leading and trailing segments despite variations in the rate and timing that ink sticks may traverse the sensor region in a feed channel so that a single sensor may be used to interact with a particular track. The transition indicating region may be present on one sensor track and not present in another sensor track. For example, FIG. 5A shows an embodiment of an ink stick 100' that incorporates a transition indicating region 134' in sensor track 124 while sensor track 120 does not have a transition indicating region.

Figure 6:
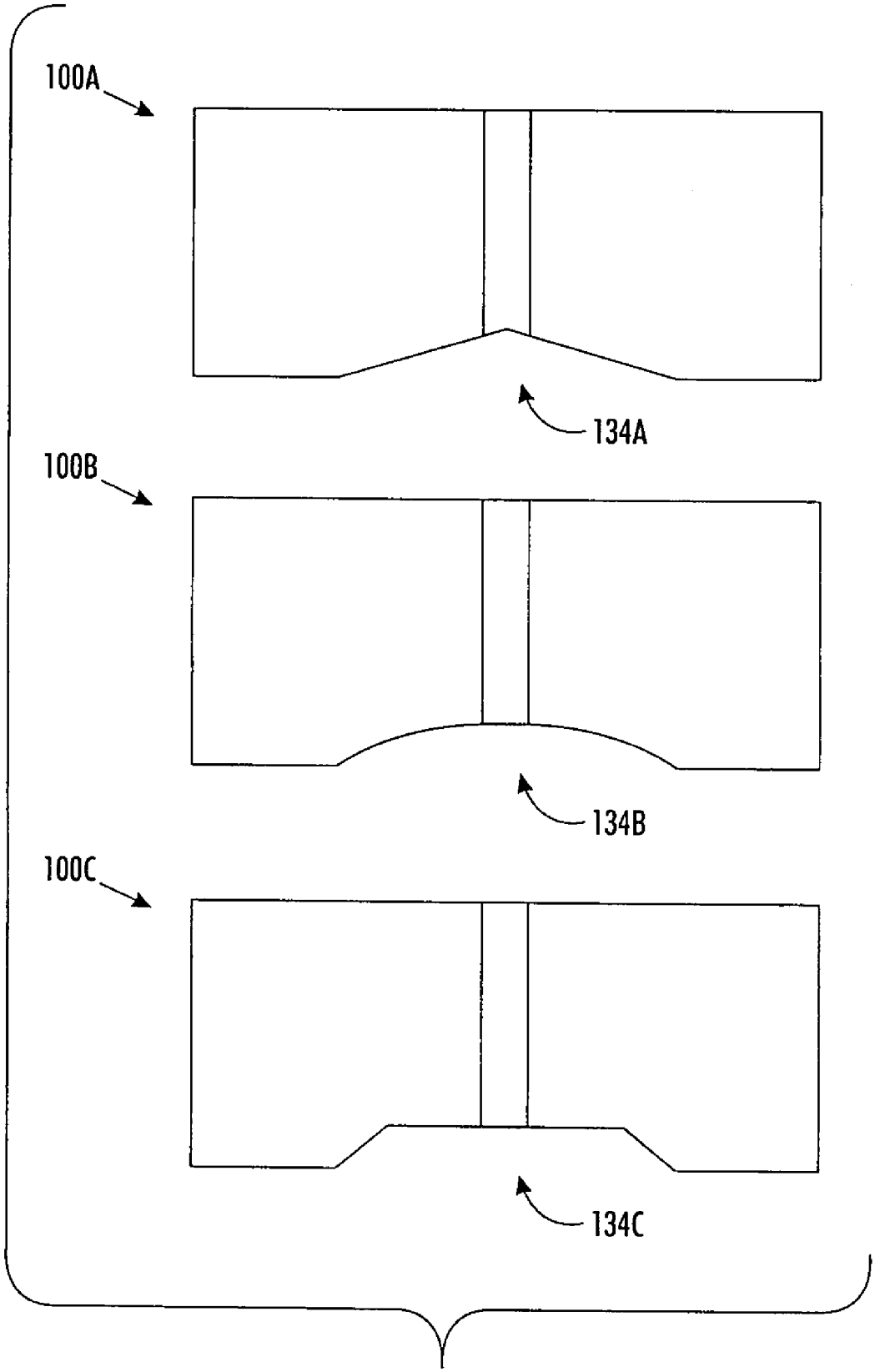
FIG. 6 shows alternative embodiments of the transition indicating region of the ink stick of FIG. 3.

In the embodiment of FIGS. 3-5, the transition indicating region 134 comprises a void or relief formed in the coded sensor feature between the leading sensor actuator location and the trailing sensor actuator locations of each track. The transition indicating region is configured to interact with the track sensors of each track to generate a signal indicative of a transition between the leading and trailing sensor actuators. For example, in an embodiment in which the leading and trailing sensor actuators of the track are configured to produce a "high" signal output, the transition indicating region is configured to produce a simultaneous "low" output from each track sensor. Thus, the control system may be programmed with the knowledge that a simultaneous "low" output from the track sensors indicates that the leading sensor actuators have passed through the sensor region and that the next actuations of the track sensors are to be caused by the trailing sensor actuators. FIG. 6 shows examples of some alternative embodiments of transition indicating regions 134A-C. As can be seen, transition indicating regions may have curved, angled, or rounded surfaces or any combination of these surfaces so long as the transition indicating region is capable of interacting with the track sensors to provide the indication of a transition from the leading to the trailing sensor actuators.

The configuration and arrangement of sensor actuators may be used to implement a data encoding scheme. Depending on the encoding scheme implemented, the actuation of sensors by the sensor actuators generates a coded signal pattern that corresponds to variable control information pertaining to the ink stick. The coded signal pattern may take any form that is suitable to convey information to an imaging device control system such as one or more waveforms. A variety of encoding schemes may be implemented in the coded sensor feature to encode ink stick data onto an ink stick. The encoding scheme implemented may depend on a variety of factors such as the number of sensor actuators, number of tracks, number of sensors, etc.

The coded sensor feature of the ink stick of FIGS. 3-5 may be used to implement an encoding scheme based on the order or sequence of actuation of the track sensors. To implement an encoding scheme based on actuation sequence, the sensor actuators of one track are offset from the sensor actuators of other tracks so that the sensor actuators of the respective tracks actuate the sensors at different times as the ink stick is moved along a feed channel. In particular, the sensor actuators in the leading segments of the tracks may be offset from each other as well as the sensor actuator of the trailing segments of the tracks. For example, in FIG. 5, the leading sensor actuator 118 of track 120 is positioned closer to the leading end 148 of the ink stick than the leading sensor actuator 114 of track 124 so that as the ink stick is moves along the respective feed channel, the leading sensor actuator 118 actuates the track sensor (not shown) for track 120 before the leading sensor actuator 114 of track 124 actuates the track sensor (not shown) for track 124. Similarly, the trailing sensor actuator 110 of track 120 is positioned to actuate the track sensor for track 120 before the trailing sensor actuator 108 of track 124 actuates the track sensor for track 124. Multiple transitions of a sensor may occur relative to one sensor feature, regardless of the sensing means. For example, curved sensor features that cause an optical sensor to receive sufficient actuating reflected light then, as the stick moves, insufficient light for sensor actuation and then with further movement, again entering a region where reflected light intensity is sufficient to actuate the sensor. These additional, variable and/or intermittent sensor transitions may be planed as part of the ink stick sensor feature configuration or may be accommodated by a control system so that additional signal transactions are ignored or do not factor into interpretation of the sensor feature code.

Figure 7:
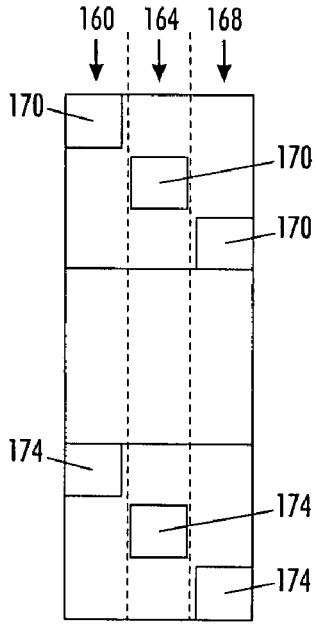
FIG. 7 shows an embodiment of an ink stick having a coded sensor feature with three tracks.
Figure 8:
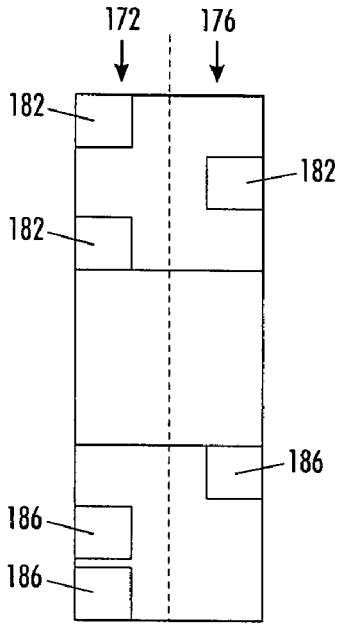
FIG. 8 shows an embodiment of an ink stick having a coded sensor feature in which the tracks may have multiple leading and/or trailing sensor actuators.

By varying the order of actuation of the respective tracks sensors by the sensor actuators in the leading and trailing segments of the tracks, a plurality of possible actuation sequences are possible. The number of possible actuation sequences may be expanded by including three or more tracks in the coded sensor feature and corresponding track sensors in the feed channel. FIG. 7 shows an example of a coded sensor feature that includes three tracks 160, 164, 168. Each track includes a leading sensor actuator 174 and a trailing sensor actuator 170. In another embodiment, a coded sensor feature may include one or more tracks that have multiple leading and/or trailing sensor actuators. For example, FIG. 8 shows an embodiment of a coded sensor feature that includes two tracks 172, 176. As can be seen, track 172 includes multiple leading 186 and trailing 182 sensor actuators.

Figure 9:
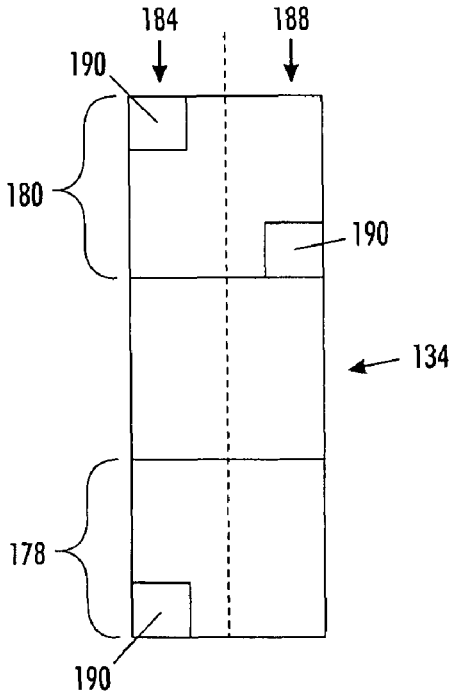
FIG. 9 shows an embodiment of an ink stick having a coded sensor feature in which a sensor actuator is not positioned at one of the leading and/or trailing ends of one of the tracks.
Figure 10:
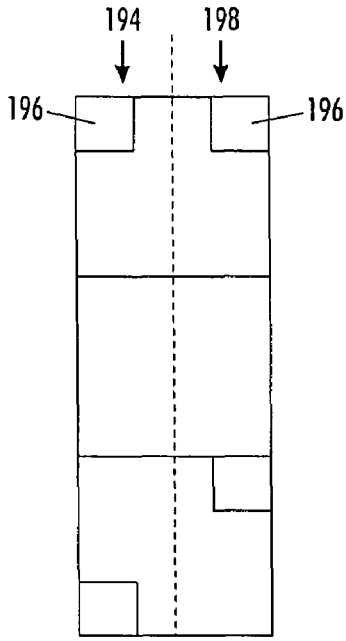
FIG. 10 shows an embodiment of an ink stick having a coded sensor feature in which the tracks include sensor actuators positioned to simultaneously actuate the track sensors.

In addition, extensibility to the number of possible actuation sequences may be provided by including sequences in which one or more of the segments do not include a sensor actuator for actuating the respective track sensor. For example, FIG. 9 shows an embodiment of a coded sensor feature in which the leading segment 178 of track 188 does not include a sensor actuator 190. Similarly, simultaneous sensor actuations may be utilized to provide even more extensibility depending on the tolerance of the sensor system. For example, FIG. 10 shows an embodiment of a coded sensor feature that includes two tracks 194, 198. The trailing sensor actuators 196 in the tracks 194, 198 are positioned to actuate the respective track sensors substantially simultaneously.

Information may be encoded into a coded sensor feature 80 by selecting one of the possible actuation sequences to be indicated by a coded sensor feature 80 and configuring or arranging the plurality of sensor actuators of the tracks to actuate sensors in the selected sequence. Each of the possible actuation sequences may be assigned to indicate control and/or attribute information that pertains to an ink stick. The actuation sequence generated by a coded sensor feature may be read by an imaging device control system and translated into the control and/or attribute information pertaining to the ink stick that may be used in a number of ways by the control system. The control system may use the actuation sequence as a lookup key for accessing data stored in a data structure, such as, for example, a database or table. The data stored in the data structure may comprise a plurality of possible actuation sequences with associated information corresponding to each code word.

Figure 11:
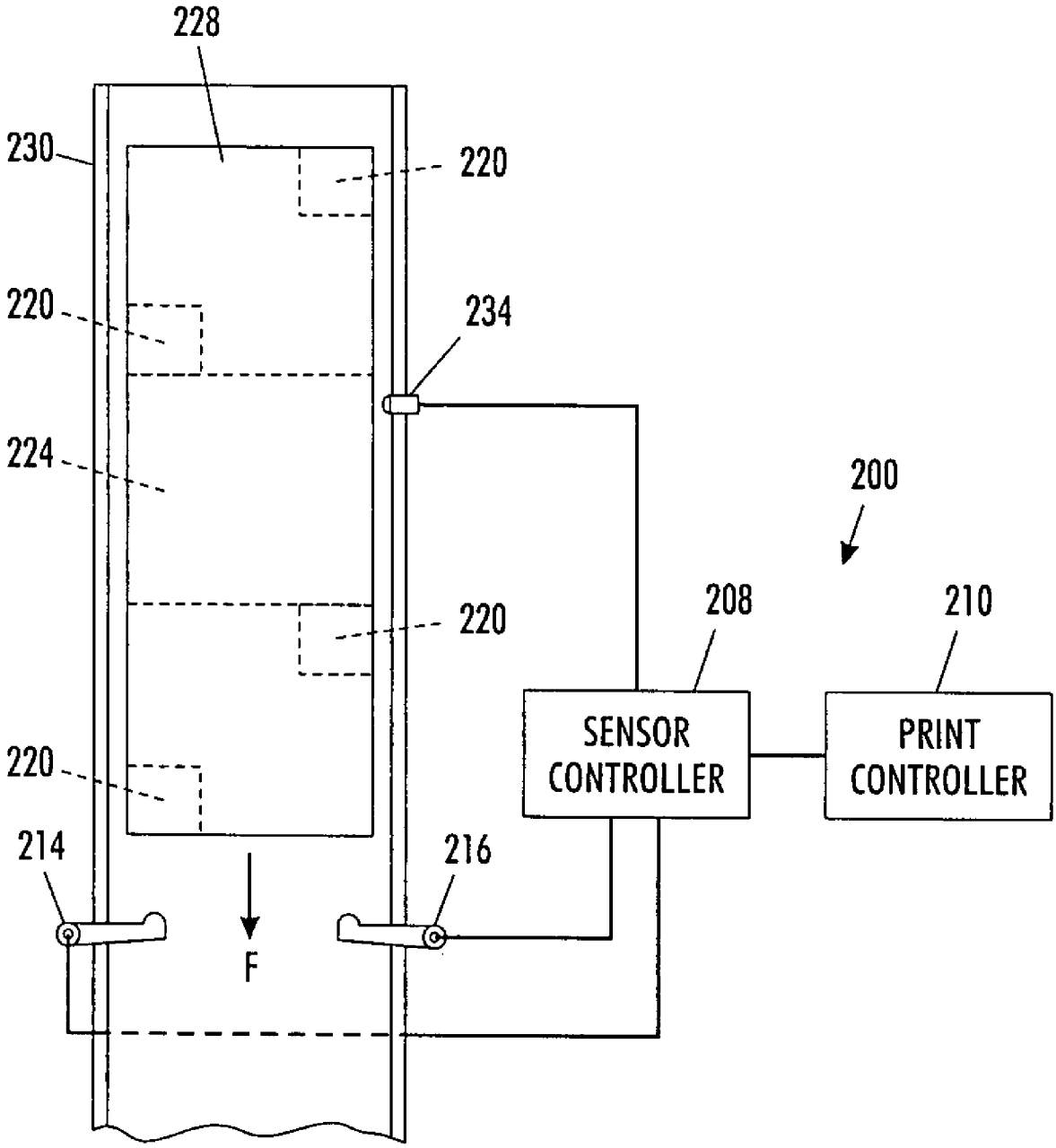
FIG. 11 is a top view of an embodiment of a feed channel that includes a sensor system for reading a coded sensor feature of the ink stick of FIG. 3.

An ink loader may include a sensor system for interacting with the coded sensor feature of an ink stick. Referring now to FIG. 11, the sensor system 200 of an ink loader 204 may include a sensor controller 208 in communication with print controller 210 and one or more track sensors 214, 218 for detecting sensor actuators 220 and/or transition indicating regions 224 of a coded sensor feature as an ink stick 228 is urged along a feed channel 230. The track sensors 214, 218 may comprise mechanically settable flags, optical sensors, or any suitable type of sensor. The track sensors generate signals in response to presence and/or absence of sensor actuators, transition indicating regions each sensing or detection of sensor actuators of the tracks of the coded sensor feature as they pass the sensors in the feed channel.

The track sensors 214, 218 may be positioned in any suitable location in the feed channel 230 depending on the location of the tracks on an ink stick. For example, in the embodiment of FIG. 11, the track sensors are positioned adjacent the bottom of the feed channel for sensing the tracks of the ink stick of FIGS. 3-5 which are positioned along the bottom surface of the ink stick. The track sensors are positioned near the insertion area of the feed channel so any forward movement from the insertion area may initiate the "reading" of the coded sensor feature of the ink stick. Code reading in the channel, however, may occur one or more times at one or more positions along the path of travel of the ink stick.

To further facilitate accurate and reliable reading of the coded sensor feature, the sensor system 200 may include an ink stick insertion sensor 234 positioned proximate the insertion area of the feed channel 230 to detect the insertion of an ink stick into the feed channel. The insertion sensor 234 is configured to generate a signal for the sensor controller 208 that is indicative of the presence of an ink stick in the insertion area. The insertion sensor 234 may comprise any suitable type of sensor such as a mechanically settable flag or optical sensor that is positioned, for example, beneath an insertion opening of a feed channel. In response to the signal indicating the presence of an ink stick at the insertion area, the sensor controller may prepare the sensors for actuation by, for example, enabling the track sensors, resetting the state of track sensors in a controller, signaling a known relative position of the ink stick as it moves in the feed direction, etc.

Those skilled in the art will recognize that numerous modifications can be made to the specific implementations described above. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink stick for use in an ink loader of an imaging device, the ink stick comprising:

an ink stick body configured to be received in a feed channel of an ink loader of a phase change ink imaging device and to be moved in the feed channel in a feed direction from an insertion end to a melt end of the feed channel, the ink stick body including a leading end and a trailing end, the ink stick body being configured for insertion into the ink loader with the leading end oriented in the feed direction and the trailing end oriented opposite the feed direction;

a plurality of first sensor actuators located proximate the leading end of the ink stick body, the first sensor actuators comprising insets into an exterior surface of the ink stick body, the plurality of first sensor actuators being positioned on the ink stick body to interact with at least one sensor in the feed channel as the ink stick body is moved toward the melt end to generate a first signal corresponding to a first portion of a code word, the first signal corresponding to an order in which the sensors in the feed channel are actuated by the plurality of first sensor actuators of the tracks;

a plurality of second sensor actuators located proximate the trailing end of the ink stick body and arranged on the ink stick body, the second sensor actuators comprising insets into an exterior surface of the ink stick body, the plurality of second sensor actuators being positioned on the ink stick body to interact with the at least one sensor in the feed channel as the ink stick body is moved toward the melt end to generate a second signal corresponding to a second portion of the code word, the code word corresponds to variable control information pertaining to the ink stick body and the second signal corresponds to an order in which the sensors in the feed channel are actuated by the plurality of second sensor actuators, the plurality of first sensor actuators and the plurality of second sensor actuators being arranged in tracks along the ink stick body, each track forming a path substantially parallel to the feed direction of the ink loader positioned on the ink stick body to interact with a separate sensor in the feed channel; and a transition indicator positioned on the ink stick body between the plurality of first sensor actuators and the plurality of second sensor actuators, the transition indicator comprising a relief formed in the exterior surface of the ink stick between the plurality of first sensor actuators and the plurality of second sensor actuators, the relief being configured to interact with the sensors in the feed channel to generate a transition signal indicative of a transition from the generation of the first signal to the generation of the second signal.

2. The ink stick of claim 1, the variable control information comprising a stock keeping unit (SKU) designation pertaining to the ink stick body.

3. The ink stick body of claim 1, the first and the second sensor actuators being configured to actuate the sensors in the feed channel by mechanically moving a flag.

4. The ink stick of claim 1, the first and the second sensor actuators being configured to actuate the sensors based on light reflected from the sensor actuators.

5. A system for a phase change imaging device, the system comprising:

a coded sensor feature formed on an exterior surface of an ink stick, the coded sensor feature including a plurality of first sensor actuators and a plurality of second sensor actuators, the plurality of first sensor actuators being arranged proximate a leading end of the ink stick in a first sequence, the plurality of second sensor actuators being arranged proximate a trailing end of the ink stick in a second sequence;

a transition indicating region formed on the exterior surface of the ink stick between the plurality of first sensor actuators and the plurality of second sensor actuators;

an ink stick insertion sensor for detecting an insertion of an ink stick and for generating a signal indicative of the insertion of the ink stick;

a sensor system in an ink loader of the phase change imaging device for detecting the plurality of first sensor actuators and the plurality of second sensor actuators and to generate a first signal corresponding to the first sequence and a second signal corresponding to the second sequence, the first signal and the second signal comprising portions of a code word, the code word corresponding to variable control information pertaining to the ink stick, the sensor system being configured to detect the transition indicating region to differentiate between the detection of the plurality of first sensor actuators and the detection of the plurality of second sensor actuators; and a print controller configured to receive the first and the second signals, to decode the first and the second signals to determine the code word, and to affect imaging operation of the phase change ink imaging device with reference to the code word.

6. The system of claim 5, the variable control information comprising a stock keeping unit (SKU) designation pertaining to the ink stick.

7. The system of claim 5, the plurality of first sensor actuators and the plurality of second sensor actuators being arranged in tracks along the ink stick body, each track forming a path substantially parallel to the feed direction of the ink loader.

8. A system for a phase change imaging device, the system comprising:

a coded sensor feature formed on an exterior surface of an ink stick, the coded sensor feature including a plurality of first sensor actuators and a plurality of second sensor actuators, the plurality of first sensor actuators being arranged in a track along the ink stick body proximate a leading end of the ink stick body in a first sequence, the plurality of second sensor actuators being arranged in a track along the ink stick body proximate a trailing end of the ink stick in a second sequence, each track forming a path substantially parallel to the feed direction of the ink loader;

a transition indicating region formed on the exterior surface of the ink stick between the plurality of first sensor actuators and the plurality of second sensor actuators;

a sensor system in an ink loader of the phase change imaging device, the sensor system including a track sensor positioned in the ink loader for each track on the ink stick to detect the plurality of first sensor actuators and the plurality of second sensor actuators and to generate a first signal corresponding to the first sequence and a second signal corresponding to the second sequence, the first signal and the second signal comprising portions of a code word, the code word corresponding to variable control information pertaining to the ink stick, the sensor system being configured to detect the transition indicating region to differentiate between the detection of the plurality of first sensor actuators and the detection of the plurality of second sensor actuators; and a print controller configured to receive the first and the second signals, to decode the first and the second signals to determine the code word, and to affect imaging operations of the phase change ink imaging device with reference to the code word.

9. The system of claim 8, the first signal corresponding to an order in which the track sensors in the feed channel are actuated by the plurality of first sensor actuators; and the second signal corresponding to an order in which the track sensors in the feed channel are actuated by the plurality of second sensor actuators.

10. The system of claim 9, the transition indicating region comprising a relief formed in the exterior surface of the ink stick between the first sensor actuators and the second sensor actuators of each track.

11. A method of feeding ink sticks in an ink loader of a phase change imaging device, the method comprising:

inserting an ink stick into an ink loader of a phase change imaging device, the ink stick including a coded sensor feature formed on an exterior surface of the ink stick, the coded sensor feature including a plurality of first sensor actuators and a plurality of second sensor actuators, the plurality of first sensor actuators being arranged in a track along the ink stick body proximate a leading end of the ink stick body in a first sequence, the plurality of second sensor actuators being arranged in a track along the ink stick body proximate a trailing end of the ink stick in a second sequence, each track tracks, each track being substantially parallel to a feed direction of the ink loader on the exterior surface of the ink stick, each track including a plurality of leading sensor actuators and a plurality of trailing sensor actuators, the leading sensor actuators and the trailing sensor actuators in each track being arranged in an actuation sequence, the ink stick including a transition indicating region formed on the exterior surface in each track between the leading sensor actuators and the trailing sensor actuators in each track;

detecting the the first plurality of leading sensor actuators in each track with a plurality of track sensors;

detecting the transition indicating region;

setting the plurality of track sensors to detect the the second plurality of trailing sensor actuators in each track in response to the detection of the transition indicating region;

detecting the second plurality of trailing sensor actuators in each track with the plurality of track sensors;

generating a first signal indicative of the actuation sequence based on the detection of the first plurality of leading sensor actuators in a track;

generating a second signal indicative of the actuation sequence based on the detection of the plurality of the trailing sensor actuators in the track, the first signal and the second signal for a track comprising a code word, the code word corresponding to variable control information pertaining to the ink stick, decoding the first and the second signals to determine variable control/attribute information pertaining to the ink stick that corresponds to the code word; and affecting imaging operations of the phase change ink imaging device with reference to the code word.

12. The method of claim 11, the decoding of the first and the second signals further comprising:

decoding the first and second signals to determine a stock keeping unit (SKU) designation pertaining to the ink stick.

* * * * *